US010858905B2

(12) United States Patent
Randle et al.

(10) Patent No.: US 10,858,905 B2
(45) Date of Patent: Dec. 8, 2020

(54) JETTISONABLE BALL SEAL

(71) Applicant: CAJUN SERVICES UNLIMITED, LLC, Gray, LA (US)

(72) Inventors: Bryce Elliott Randle, Highlands Ranch, CO (US); Patrick Francis Campbell, Katy, TX (US)

(73) Assignee: CAJUN SERVICES UNLIMITED, LLC, Gray, LA (US)

( * ) Notice: Subject to any disclaimer, the term of this patent is extended or adjusted under 35 U.S.C. 154(b) by 346 days.

(21) Appl. No.: 15/624,391

(22) Filed: Jun. 15, 2017

(65) Prior Publication Data

US 2017/0362913 A1 Dec. 21, 2017

Related U.S. Application Data

(60) Provisional application No. 62/350,284, filed on Jun. 15, 2016.

(51) Int. Cl.
*E21B 33/12* (2006.01)
*E21B 43/04* (2006.01)

(52) U.S. Cl.
CPC ..... *E21B 33/1208* (2013.01); *E21B 43/04* (2013.01)

(58) Field of Classification Search
CPC ..... E21B 2034/007; E21B 33/1208; E21B 43/04; E21B 43/26
See application file for complete search history.

(56) References Cited

U.S. PATENT DOCUMENTS 5,180,016 A * 1/1993 Ross ..... E21B 23/04 166/194
5,205,359 A 4/1993 Stephenson
5,343,949 A * 9/1994 Ross ..... E21B 17/07 166/278
5,775,421 A * 7/1998 Duhon ..... E21B 23/02 166/135
5,975,205 A * 11/1999 Carisella ..... E21B 43/045 166/134
2004/0020652 A1* 2/2004 Campbell ..... E21B 34/10 166/313
2013/0048291 A1* 2/2013 Merron ..... E21B 34/063 166/305.1
2015/0075780 A1* 3/2015 Richards ..... E21B 17/04 166/250.1
2017/0089159 A1* 3/2017 Sullivan ..... E21B 31/00

FOREIGN PATENT DOCUMENTS

WO WO 2016/126823 8/2016

OTHER PUBLICATIONS

"Downhole Sand Control Components," Halliburton, Jun. 2005, 58 pages.

* cited by examiner

*Primary Examiner* — Robert E Fuller
*Assistant Examiner* — Theodore N Yao
(74) *Attorney, Agent, or Firm* — Sheridan Ross P.C.

(57) ABSTRACT

A device, system and method are provided for using a seal sub to isolate a well. The seal sub generally has a primary channel extending through the seal sub and seat positioned within the primary channel. As a ball setting tool passes through the seal sub and the seat, a ball connected to the setting tool with a shear pin contacts the seat and selectively connects to the seal sub. A predetermined force can be applied to the ball setting tool to break the shear pin, which leaves the seal ball in place, and the seal sub and the seal ball isolate the downhole pressures and contents from the uphole pressures and contents.

5 Claims, 16 Drawing Sheets

JETTISONABLE BALL SEAL

CROSS-REFERENCE TO RELATED APPLICATIONS

This application claims priority to U.S. Provisional Patent Application Ser. No. 62/350,284 filed Jun. 15, 2016, which is incorporated herein in its entirety by reference.

FIELD OF THE INVENTION

The invention relates to an apparatus and methods for allowing isolation of a well during multiple phases of drilling and completions.

BACKGROUND OF THE INVENTION

In the oil and gas industry, wellbores are drilled into the earth using drilling rigs, where tubulars are threaded together to form long tubular strings that are inserted into the wellbore to extract the desired fluid. Exposure of various rock types and corresponding pressures during drilling and most commonly, post fracturing and acidizing stimulation work, requires a means for isolating the formation downhole by means of closing a valve or sealing off so that wellhead pressure can be bled off for building an alternative tool string uphole of any desired length and lowering that tool string downhole without a need for snubbing under wellhead pressure for the purpose of performing wellbore operations downhole during a single trip into the wellbore or to manipulate fluid type and properties without risk of the exposed formation below the seal affecting the ability to control the well above the seal.

To achieve this, valves are used that open and close to isolate and then expose the formation below and the subsequent hydrocarbon. In addition, many operators utilize existing technologies that require the use of rotation, reciprocation, nitrogen, or restrict operability in subsequent operations after closure.

What is needed, therefore, is a means to provide a simple mechanical seal that integrates into any string configuration, capable of sealing from above and below with the ability for the seal to be disposed of or retrieved with existing technology.

SUMMARY OF THE INVENTION

The invention would provide an additional barrier between reservoirs or pressured zones and the surface and allowing for isolation of pressure from below and fluid loss from above, thus meeting a multiple barrier guideline often required by operator policy and governmental regulatory requirements. In particular, but not exclusively, the invention relates to a tool for, and a method of, isolating formation pressure from exiting the well and drilling or completion fluid from entering the same zones when activated while permitting an ability to jettison the sealing element at a later time when desired. This invention is applicable to well construction operations, gravel packing and fracturing operations, or may be used as a temporary suspension barrier.

It is therefore an aspect of embodiments of the invention to provide an isolating tool capable of preventing wellbore fluids from exiting the well and drilling and completion fluids from being lost to the well without the requirement of multiple runs, special tools, unique fluid systems such as nitrogen, or the like.

It is one aspect of embodiments of the invention to give the ability to integrate into stimulation tools and techniques and permit implementation of a seal with washpipe or similar and disposal with mechanical force or pressure.

It is another aspect of embodiments of the invention to give the ability for optional implementation prior to a decision to use and provide the ability to utilize in well construction for contingency operations such as during severe weather.

It is another aspect of embodiments of the invention to provide a means of installing the seal from both, either, or the bottom or top.

It is yet another aspect of embodiments of the invention to provide an apparatus that may be capable of holding pressure from above and an equivalent or higher pressure from below.

It is another aspect of embodiments of the invention to provide an apparatus that may be capable of being inserted into multiple size tubulars.

It is another aspect of embodiments of the invention to provide an apparatus that will provide pressure integrity above and below after installation and thus qualify as a barrier.

It is another aspect of embodiments of the invention to provide an apparatus in which the seal may be jettisoned with pressure or force.

It is another aspect of embodiments of the invention to provide an apparatus in which the jettisoned seal and/or the seal sub would be capable of retrieval or being milled.

One particular embodiment of the present invention is a method for isolating a wellbore, comprising (i) providing a seal sub, a grapple assembly coupled to the seal sub via a shear screw, a washpipe, a ball setting tool and a seal ball, wherein the ball setting tool is coupled to one end of the washpipe, and wherein the seal ball is coupled to the ball setting tool; (ii) pulling the washpipe through the interior volume of the seal sub such that a grapple catch of the seal ball contacts a ball catch lip of the seal sub; and (iii) pulling the washpipe, after the contact between the grapple catch and the ball catch lip, through an interior volume of the seal sub with a sufficient force to shear the shear screw, which causes the grapple assembly to decouple from the seal sub.

In some embodiments, the method can further comprise (iv) providing a shear screw between the seal ball and the ball setting tool; (v) pulling the washpipe through the interior volume of the seal sub such that the seal ball selectively connects to a ball seat of the seal sub; and (vi) pulling the washpipe through the interior volume of the seal sub with a sufficient force to shear the shear screw of the seal ball-ball setting tool connection, which causes the ball setting tool to decouple from the seal ball. In various embodiments, the sufficient force to shear the shear screw of the seal ball-ball setting tool connection is larger than the sufficient force to shear the shear screw of the grapple assembly-seal sub connection. In some embodiments, the method can further comprise (vii) applying an uphole pressure to dislodge the selective connection between the seal ball and the ball seat and allow the seal ball to travel downhole.

In various embodiments, the method can further comprise (viii) providing at least one grapple spring on the grapple assembly, the at least one grapple spring is configured to retain the dislodged seal ball and prevent the seal ball from travelling further downhole. In some embodiments, the method can further comprise (ix) providing a catch sub positioned downhole of the seal sub, the catch sub having a primary channel extending through the catch sub, a ball catch lever movable between a first and a second position, and a receiving volume in fluid communication with the primary channel; (x) directing, by the ball catch lever in the first position, the dislodged seal ball from the primary channel to the receiving volume; (xi) moving, by the seal ball, the ball catch lever from the first position to the second position; and (xii) retaining, by the ball catch lever in the second position, the seal ball in the receiving volume. In various embodiments, the method can further comprise (xiii) providing a bypass sub uphole of the seal sub, the bypass sub having a primary channel and a bypass line, wherein the bypass line is in fluid communication with the primary channel at a first and a second location along a longitudinal length of the primary channel; and (xiv) transferring a pressure increase from the first position, through the bypass line, and to the second position located downhole of the first position.

Another particular embodiment of the present invention is a system for isolating a wellbore, comprising a setting tool having an upper end, a lower end, and an outer diameter; a seal ball having an upper end, a lower end, and a gripping feature disposed around at least a portion of an outer circumference of the seal ball; a shear pin selectively connecting the lower end of the setting tool to the upper end of the seal ball, wherein the shear pin is configured to break in response to a predetermined force; a seal sub having a ball seat and a gripping feature, wherein at least a portion of the ball seat has an inner diameter that is larger than the outer diameter of the setting tool and that is smaller than an outer diameter of the gripping feature of the seal ball; and wherein as the setting tool passes through the ball seat, the seal ball contacts the ball seat of the seal sub, and the gripping feature of the seal ball selectively connects with the gripping feature of the seal sub, and wherein the predetermined force is applied to the setting tool and the shear pin to break the shear pin and leave the seal ball selectively connected to the seal sub.

In various embodiments, the gripping feature of the seal ball is a plurality of ribs that continuously extend around the outer circumference of the seal ball. In some embodiments, the seal sub further comprises a seal assembly that has the ball seat; and a seal retaining nut assembly that maintains the seal assembly and the ball seat in a predetermined longitudinal position in the seal sub. In various embodiments, the seal sub further comprises a grapple assembly that has the gripping feature, which is a ball catch lip, and the grapple assembly is selectively connected to an inner surface of a body of the seal sub via a shear pin, wherein the shear pin of the grapple assembly-body connection is configured to break in response to a predetermined force that is less than the predetermined force required to break the shear pin of the setting tool-seal ball connection.

In some embodiments, as the setting tool passes through the ball seat, the shear pin of the grapple assembly-body connection breaks and the grapple assembly moves from a first position to a second position where a shear ring selectively connects the grapple assembly to the body of the shear sub, and the grapple assembly maintains the seal ball against the ball seat. In various embodiments, the selective connection between the seal ball and the seal sub is configured to release in response to a pressure from an upper end of the well and a pressure from a lower end of the well, wherein the pressure from the upper end of the well is less than the pressure from the lower end of the well. In some embodiments, the grapple assembly further comprises at least one grapple spring positioned downhole of the ball seat and the gripping feature, wherein the at least one grapple spring is configured to retain the seal ball after the seal ball is dislodged from the ball seat and the gripping feature in response to a pressure from an upper end of the well.

In various embodiments, the system further comprises a ball catch sub positioned downhole of the seal sub, the ball catch sub comprising a primary channel, a ball catch lever, and a receiving volume that is in fluid communication with the primary channel; wherein in a first position the ball catch lever extends into the primary channel to direct the seal ball into the receiving volume; and wherein in a second position the ball catch lever is oriented substantially parallel to a longitudinal axis of the primary channel to contain the seal ball in the receiving volume. In some embodiments, the system further comprises a bypass sub positioned uphole of the seal sub, the bypass sub having a primary channel and a bypass line in fluid communication with the primary channel, wherein the bypass line extends from a first position to a second position along a longitudinal length of the primary channel to allow a pressure increase at the first position to transfer to the second position.

Yet another particular embodiment of the present invention is a system for isolating a wellbore, comprising a seal sub having an inner surface with an inner diameter and a lip forming a recess in the inner surface; a grapple assembly having an outer surface with an outer diameter and a collet extending outward from the outer surface, and the grapple assembly having an inner surface with a ball seat; a seal ball positioned adjacent the ball seat, and the seal ball selectively connected to the inner surface of the grapple assembly with at least one shear pin that is configured to break when subjected to a predetermined force; and wherein as the grapple assembly travels uphole, the inner surface of the seal sub deflects the collet inwards until the collet reaches the lip and deflects outward into the recess in the inner surface to secure the relative position of the seal sub and the grapple assembly.

In some embodiments, the system further comprises a pressure port through the seal sub at a location uphole of the ball seat, wherein the pressure port is in fluid communication with a downhole pressure such that the downhole pressure drives the ball seat into the seal ball; and a piston positioned in the seal sub at a location uphole of the ball seat, and the piston is operatively connected to the ball seat, wherein an uphole pressure causes the piston to drive the ball seat into the seal ball. In various embodiments, the system further comprises a bonded seal positioned on the outer surface of the grapple assembly such that the bonded seal forms a seal between the outer surface of the grapple assembly and the inner surface of the seal sub to isolate, in conjunction with the seal ball, an uphole pressure from a downhole pressure. In some embodiments, the system further comprises a wash pipe selectively connected to an upper end of the grapple assembly.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Terms such as "shear pin" and "shear screw" can be used interchangeably and generally refer to any device that breaks in response to a predetermined force.

In a preferred embodiment, the Jettison Able Ball Seal (JABS) is comprised of a seal sub and a seal ball.

Figure 1:
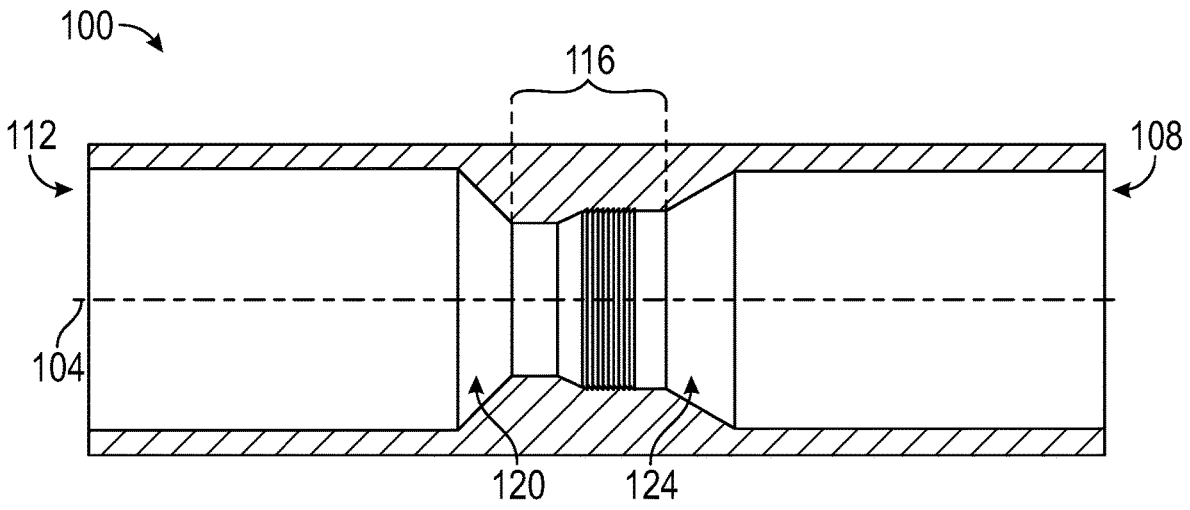
FIG. 1 is a cross-sectional view of a seal sub according to one embodiment of the invention.

Now referring to FIG. 1, a cross-sectional view of seal sub 100 of a preferred embodiment is provided. The body of seal sub 100 is cylindrical, with the exterior surface of seal sub 100 being disposed about central axis 104 and having a uniform outer diameter. Seal sub 100 is comprised of an upper portion 112 and a lower portion 108. Upper portion 112 is comprised of an opening disposed about central axis 104 at the top end, and tapered portion 120 at the bottom end. Lower portion 108 is comprised of an opening disposed about central axis 104 at the bottom end, and tapered portion 124 at the top end. A sealing portion 116 is disposed between tapered portions 120 and 124. In some embodiments, the internal diameter of upper portion 112 and lower portion 108 will be identical, whereas in other embodiments the internal diameter of upper end 112 and lower end 108 will be different.

Figure 2:
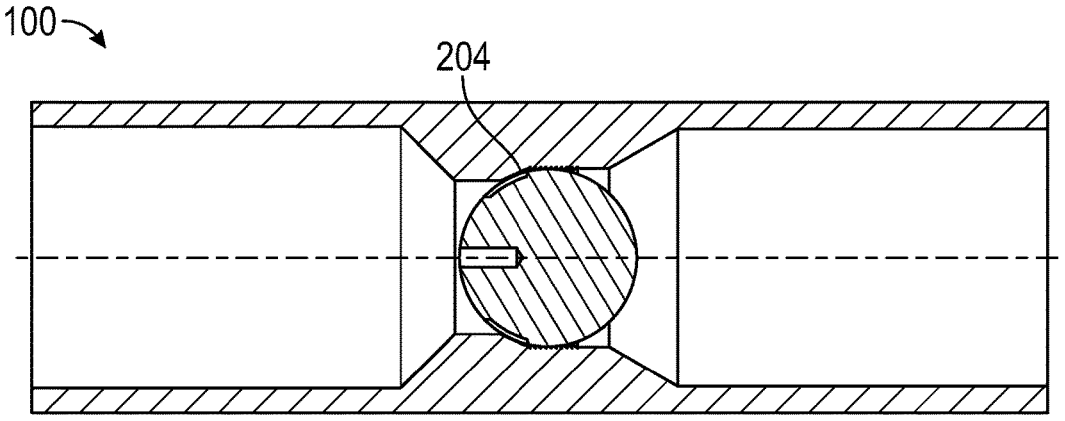
FIG. 2 is a cross-sectional view of a seal sub sealed by a seal ball according to one embodiment of the invention.

Now referring to FIG. 2, a cross-sectional view of seal sub 100 sealed by seal ball 204 of a preferred embodiment is provided. Seal ball 204 is detailed further below.

Figure 3:
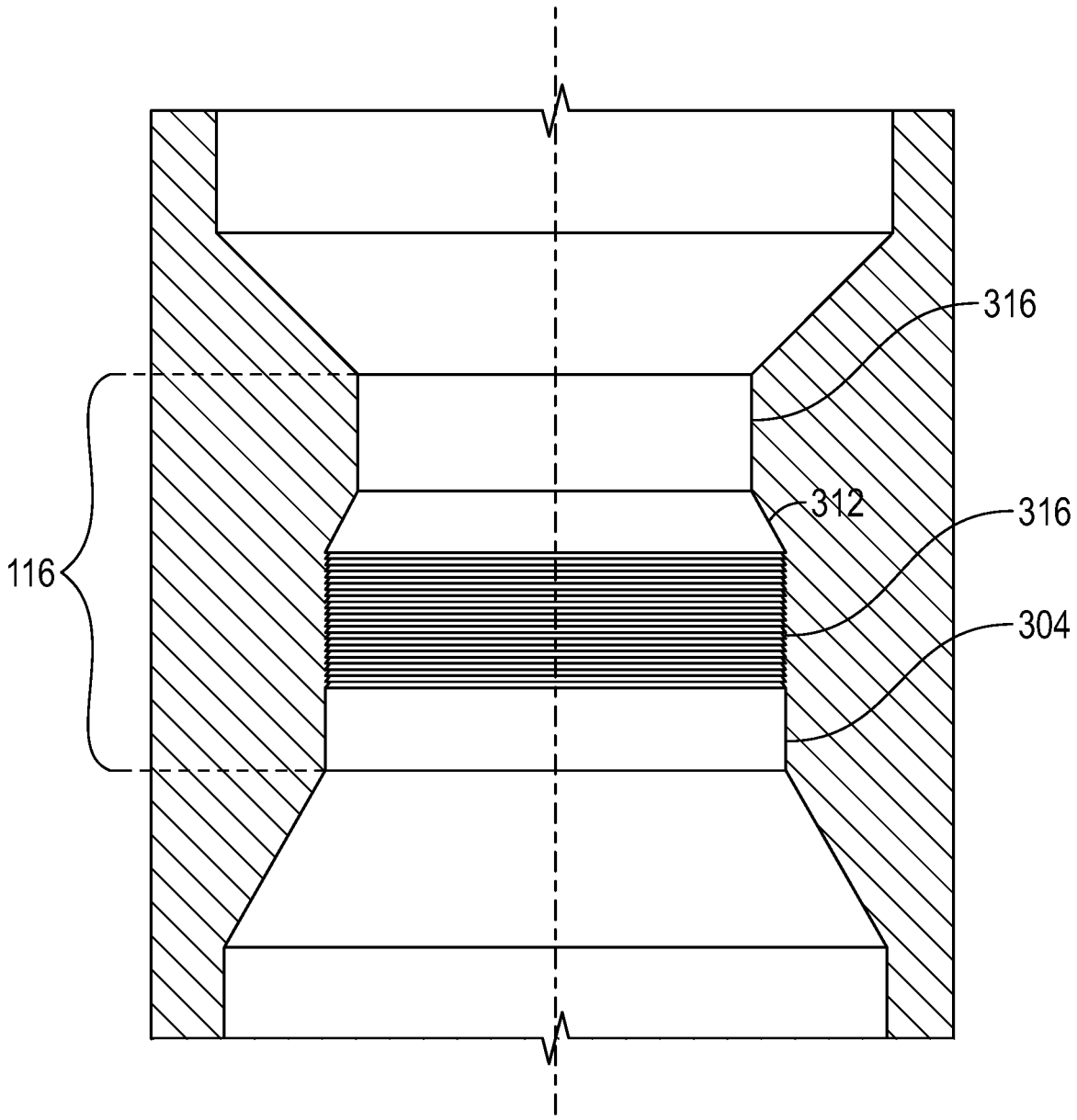
FIG. 3 is a cross-sectional view of a sealing portion of a seal sub according to one embodiment of the invention.
Figure 4A:
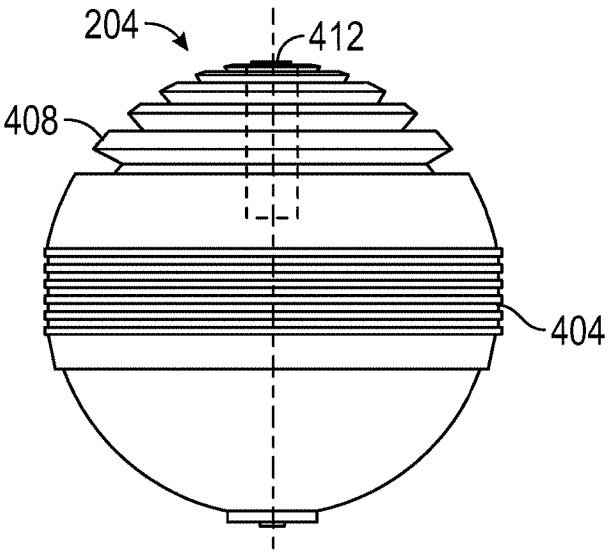
FIG. 4A is a side elevation view of a seal ball according to one embodiment of the invention.
Figure 4B:
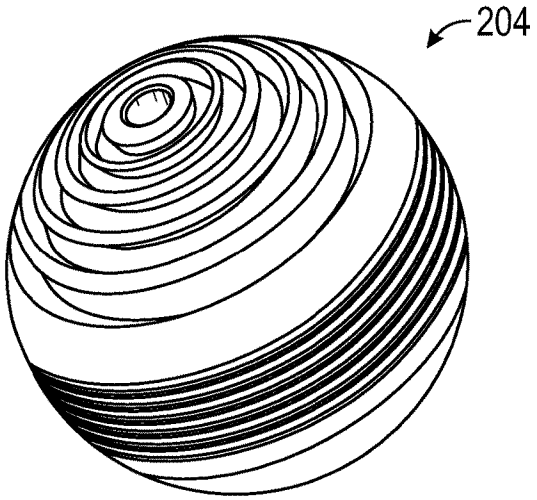
FIG. 4B is a perspective view of a seal ball according to one embodiment of the invention.
Figure 4C:
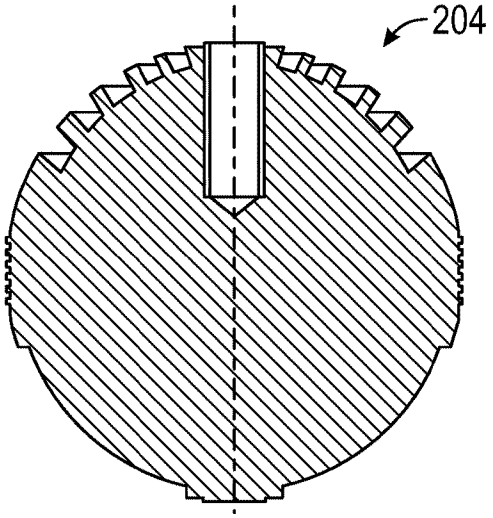
FIG. 4C is a cross-sectional view of a seal ball according to one embodiment of the invention.
Figure 4D:
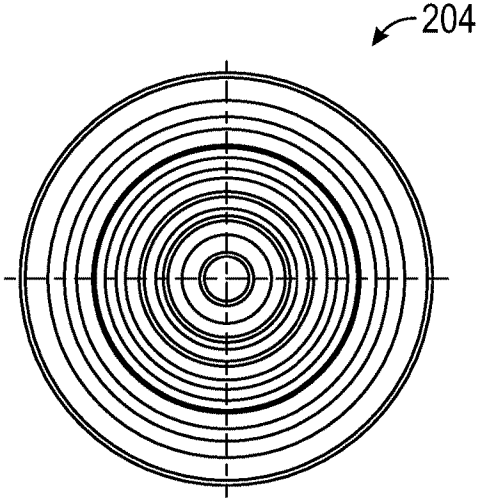
FIG. 4D is a top plan view of a seal ball according to one embodiment of the invention.

Now referring to FIG. 3, a cross-sectional view of sealing portion 116 of a preferred embodiment is provided. Sealing portion 116 is comprised of ball receiving channel 304, gripping feature 308, ball seat 312, and sealable channel 316. Ball receiving channel 304 has an internal diameter sufficiently larger than the diameter of seal ball 204 to enable the seal ball to pass through the ball receiving channel 304. In a preferred embodiment, gripping feature 308 may be comprised of a plurality of grooves, such as those disclosed by International Application No. PCT/US16/16368, which is incorporated herein by reference. Ball seat 312 has an internal diameter that is sufficiently smaller than the diameter of seal ball 204 to prevent passage of the seal ball through sealable channel 316.

Now referring to FIGS. 4A-4D, several views of seal ball 204 of a preferred embodiment are provided. In the preferred embodiment, seal ball 204 is spherical, however it will be appreciated by one skilled in the art that a seal ball 204 of other shapes may be used to practice the invention disclosed herein, such as ovoidal or conical on one end. Gripping feature 404 is disposed about the equator of seal ball 204. A bonded seal area 408 is located on the upper portion of the upper hemisphere of seal ball 204, comprising a plurality of concentric circular bonded seals. It will be appreciated that the bonded seal area 408 may cover a different portion of seal ball 204 in different embodiments. For example, bonded seal area 408 may cover the entire upper hemisphere of seal ball 204 in some embodiments, while in other embodiments the bonded seal area may comprise a single circular ridge. Seal ball 204 is further comprised of shear pin 412, which is threaded into an opening at the top of seal ball 204. In other embodiments, shear pin 412 may be comprised of any material known in the art that will shear under a predetermined amount of force. In a preferred embodiment, with the exception of shear pin 412, seal ball 204 is comprised of a single piece of material.

Figure 5B:
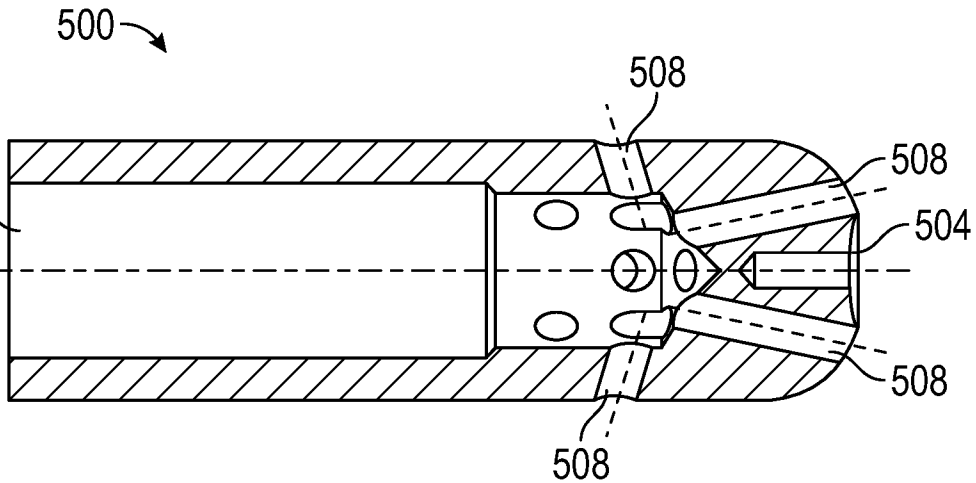
FIG. 5B is a cross-sectional view of a ball setting tool according to one embodiment of the invention.
Figure 5A:
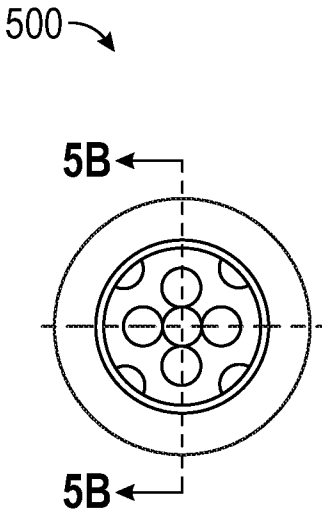
FIG. 5A is a side elevation view of a ball setting tool according to one embodiment of the invention.
Figure 5C:
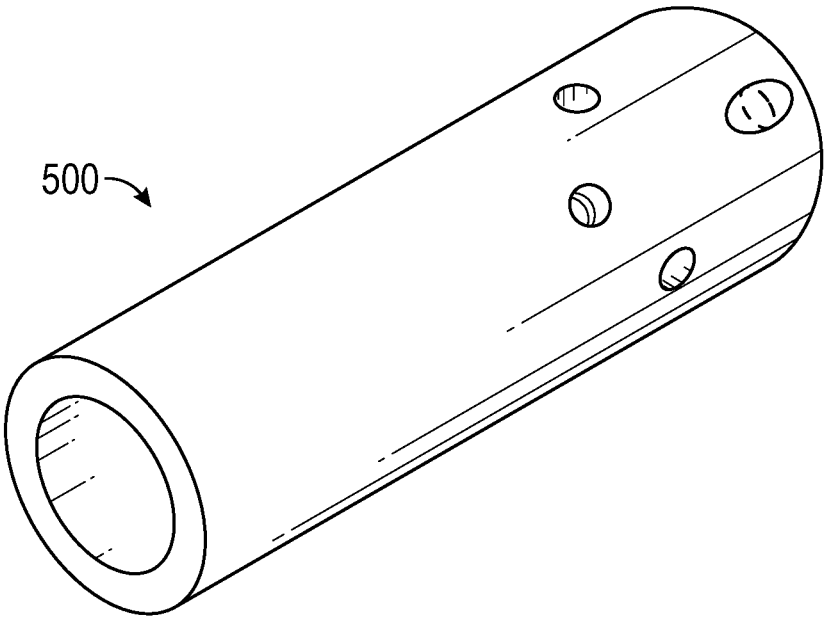
FIG. 5C is a perspective view of a ball setting tool according to one embodiment of the invention.

Now referring to FIGS. 5A-5C, several views of ball setting tool 500 of a preferred embodiment are provided. In the preferred embodiment, ball setting tool 500 is cylindrical and has an outer diameter that is less than the inner diameter of sealable channel 316. Seal ball connection point 504 is situated on the lower end of ball setting tool 500. Seal ball connection point 504 is comprised of a concave depression of substantially similar curvature of seal ball 204. Seal ball connection point 504 is further comprised of a cylindrical cavity capable of receiving shear pin shear pin 412. In some embodiments of the present invention, ball setting tool 500 may further be comprised of a plurality of debris wash ports 508 which allow for an operator to run fluid downhole to wash debris off seal ball 204 or from sealing portion 116 as desired. Washpipe connection point 512 is situated on the lower end of ball setting tool 500.

In a preferred embodiment, seal sub 100 is manufactured from a single piece of material, such that upper portion 112, lower portion 108, sealing portion 116, and tapered portions 120 and 124 are integrally connected. It will also be appreciated that in other embodiments seal sub 100 may be constructed of several components that are coupled to one another.

In a preferred embodiment, the JABS may be installed downhole as follows. Ball setting tool 500 is coupled to the end of a washpipe, and seal ball 204 is coupled to seal ball connection point 504 using shear pin 412. Seal sub 100 is made up to within a gravel pack assembly. Said gravel pack assembly is made up using methods and other components well known in the art, such as packers, extensions, service tools, polished bore receptacles, port closure sleeves, screens, etc., with the outer pipe of a gravel pack service tool being made up to the outer housing of the gravel pack assembly and the inner pipe of the gravel pack service tool being made up to the washpipe to which ball setting tool 500 is coupled. The gravel pack assembly is then run downhole. Once the gravel pack assembly reaches the desired location, a packer in the gravel pack assembly is set by the gravel pack service tool, which disengages from the outer housing of the gravel pack assembly, which includes seal sub 100, from the gravel pack service tool.

When sealing seal sub 100 is desired, the gravel pack service tool is picked up, causing the washpipe, ball setting tool 500, and seal ball 204 to move uphole. As the gravel pack service tool is pulled uphole, the washpipe is pulled through seal sub 100, moving seal ball 204 closer to seal sub 100. As the washpipe is pulled through seal sub 100, ball setting tool 500 and seal ball 204 enter ball receiving channel 304. Further pulling of the washpipe causes gripping feature 404 of seal ball 204 to engage with gripping feature 308 of seal sub 100 and bonded seal area 408 of seal ball 204 to seal against ball seat 312. The larger diameter of seal ball 204 in comparison to the internal diameter of ball seat 312 prevents seal ball 204 from passing through sealable channel 316. To complete the setting of seal ball 204, the washpipe is pulled with sufficient force to cause shear pin 412 to shear, resulting in seal ball 204 breaking free from ball setting tool 500.

Once seal ball 204 is set, the service tool and washpipe can be returned to the surface. The well is isolated and sealed above and below seal sub 100. Once sealed, seal sub 100 and seal ball 204 will withstand a predetermined amount of pressure X from above the seal, and a predetermined amount of pressure Y from below the seal. In a preferred embodiment, pressure Y is greater than pressure X, however it will be appreciated by one skilled in the art that in other preferred embodiments pressure X will be greater than or equal to pressure Y.

When it is no longer desirable to maintain the seal of seal sub 100, seal ball 204 may be jettisoned from seal sub 100 by applying downhole pressure in excess of pressure X.

Upon application of such amount of pressure, gripping feature 404 of seal ball 204 will shear, thereby disengaging seal ball 204 from seal sub 100 and allowing fluid to freely pass through sealable channel 316. In some embodiments of the present invention, seal ball 204 will fall down the well. In some embodiments of the present invention, seal sub 100 may further comprise a catch device to prevent seal ball 204 from reentering ball receiving channel 304 and/or seal sub 100.

Figure 6A:
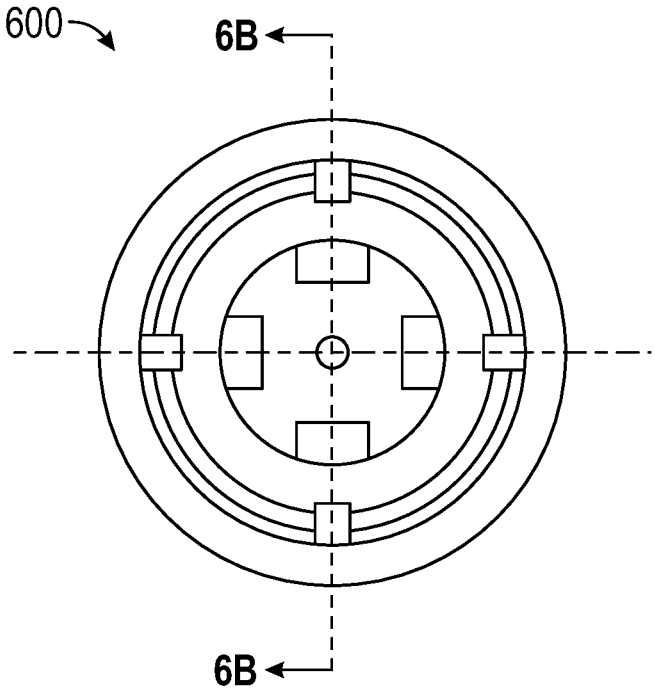
FIG. 6A is a side elevation view of a seal sub according to an alternative embodiment of the invention.
Figure 6B:
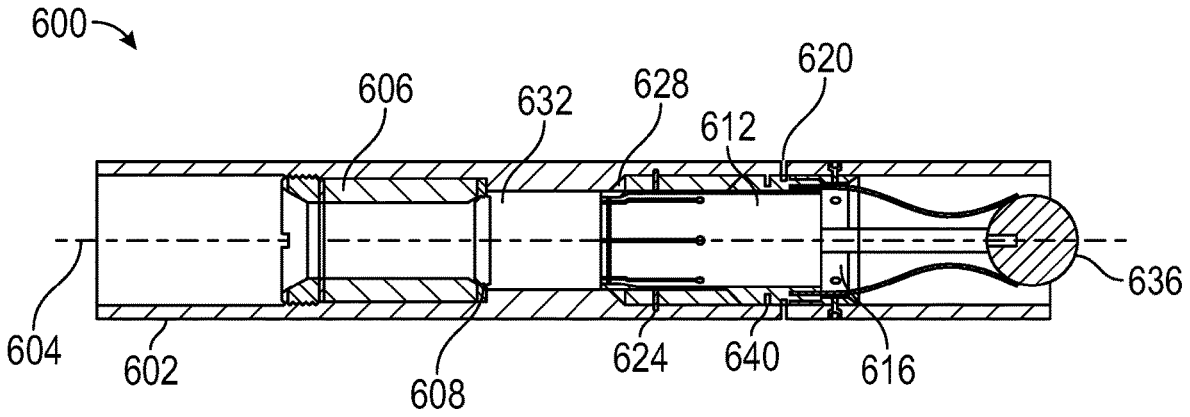
FIG. 6B is a cross-sectional view of a seal sub according to an alternative embodiment of the invention.
Figure 6C:
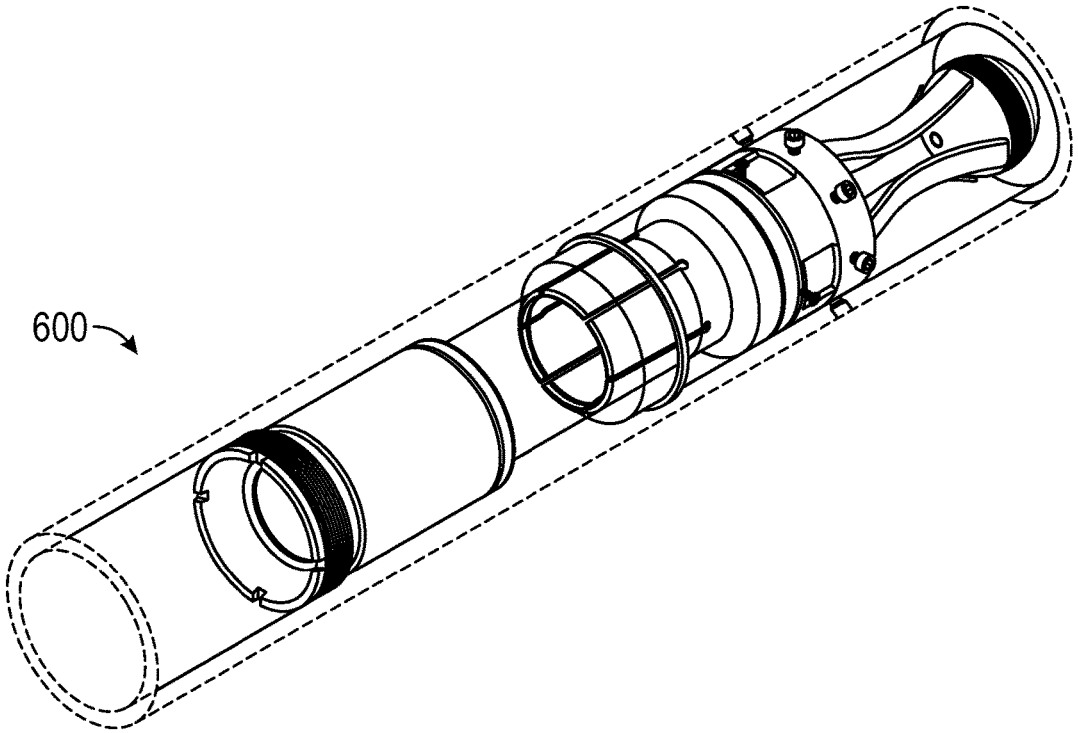
FIG. 6C is a perspective view of a seal sub according to an alternative embodiment of the invention.

Now referring to FIGS. 6A-6C, several views of an alternative preferred embodiment of the present invention are provided. The seal sub body 602 of seal sub 600 is cylindrical, with the exterior surface of seal sub 600 being disposed about central axis 604 and having a uniform outer diameter. In a preferred embodiment of the present invention, disposed within seal sub 600 are seal retaining nut assembly 606, seal assembly 608, grapple assembly 612, and grapple stop sleeve 616. Further, as will be described below, grapple shear screw 620 couples grapple assembly 612 to the interior wall of seal sub body 602. The interior wall of seal sub body 602 further comprises grapple shear ring receiver 624 and grapple stop wall 628. Sealable channel 632 is disposed between seal assembly 608 and grapple assembly 612. Although seal ball 636 is shown in FIGS. 6A-6C, seal ball 636 is not present in this location until after seal ball 636 has been jettisoned as described below, and is present in these figures for purposes of illustrating the use of the springs of grapple assembly 612 which are also described below.

Figure 7A:
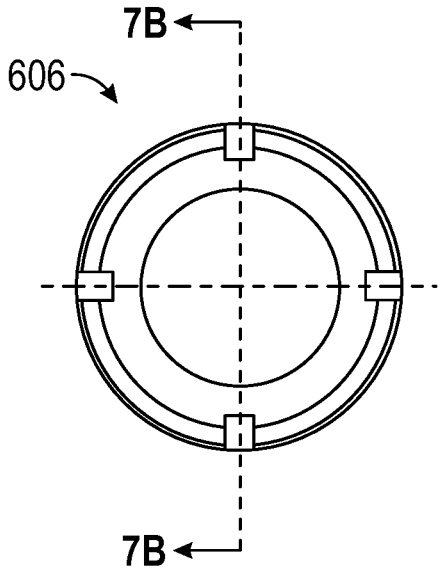
FIG. 7A is a side elevation view of a seal retaining nut assembly according to an alternative embodiment of the invention.
Figure 7B:
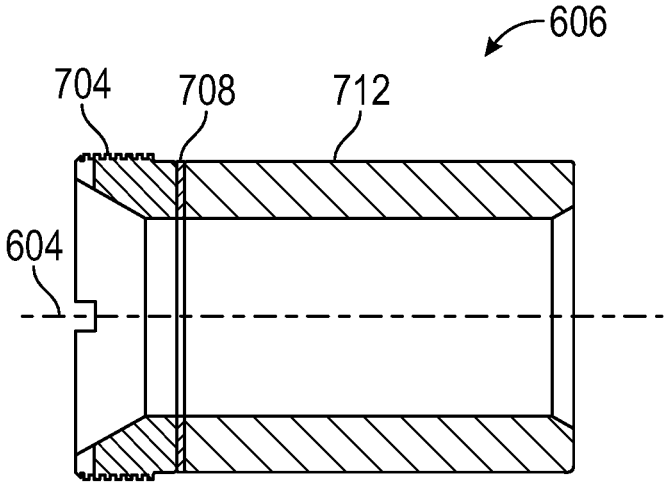
FIG. 7B is a cross-sectional view of a seal retaining nut assembly according to an alternative embodiment of the invention.
Figure 7C:
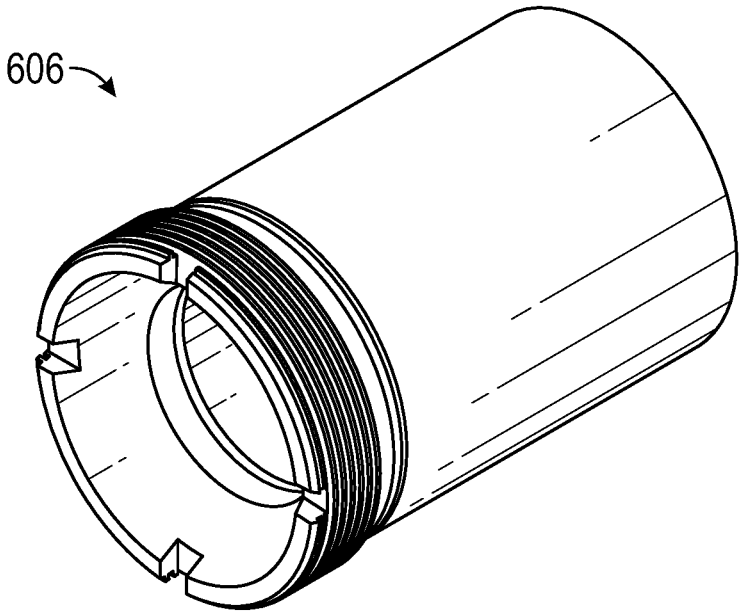
FIG. 7C is a perspective view of a seal retaining nut assembly according to an alternative embodiment of the invention.

Now referring to FIGS. 7A-7C, several views of seal retaining nut assembly 606 of an alternative preferred embodiment of the present invention are provided. Seal retaining nut assembly 606 secures seal assembly 608 in the correct location inside of seal sub body 602. Seal retaining nut assembly 606 is comprised of retaining nut 704, thrust washer 708, spacing bushing 712. In some preferred embodiments of the present invention, seal retaining nut assembly 606 is further comprised of a seal spring that is disposed about central axis 604 between thrust washer 708 and seal assembly 608 for the purpose of maintaining the integrity of the seal between seal ball 636 and ball seal 908 during the jettisoning process set forth below.

Figure 8A:
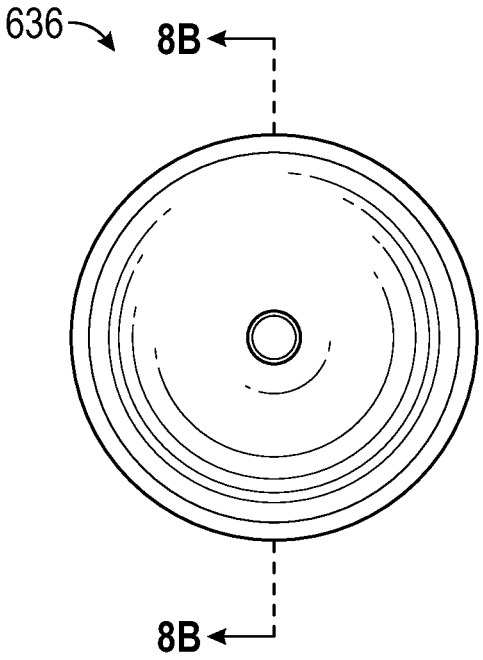
FIG. 8A is a side elevation view of a seal ball according to an alternative embodiment of the invention.
Figure 8B:
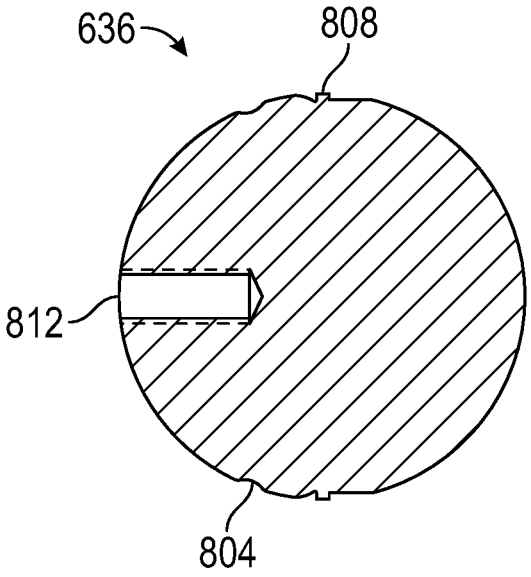
FIG. 8B is a cross-sectional view of a seal ball according to an alternative embodiment of the invention.
Figure 8C:
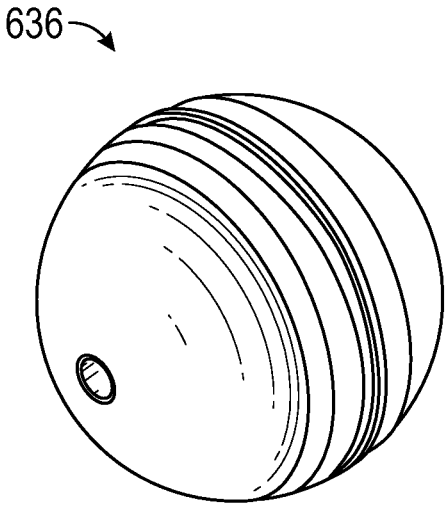
FIG. 8C is a perspective view of a seal ball according to an alternative embodiment of the invention.

Now referring to FIGS. 8A-8C, several views of seal ball 636 of an alternative preferred embodiment of the present invention are provided. In the preferred embodiment, seal ball 636 is spherical, however it will be appreciated by one skilled in the art that a seal ball 636 of other shapes may be used to practice the invention disclosed herein, such as ovoidal or conical on one end. Seal ball 636 is comprised of seal receiving groove 804, grapple catch 808, and shear pin cavity 812.

Figure 9C:
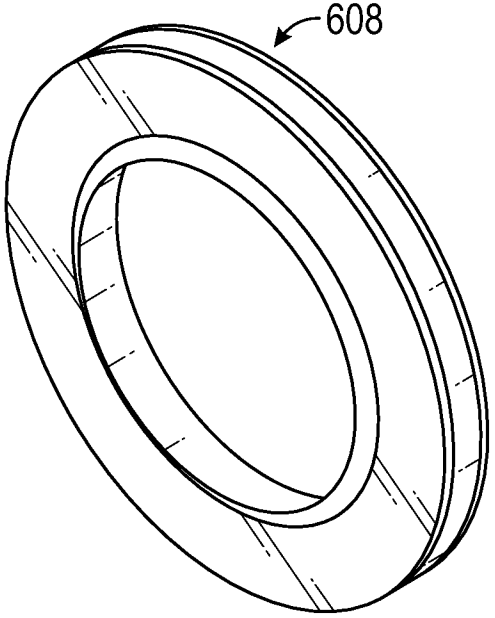
FIG. 9C is a perspective view of a seal assembly according to an alternative embodiment of the invention.
Figure 9B:
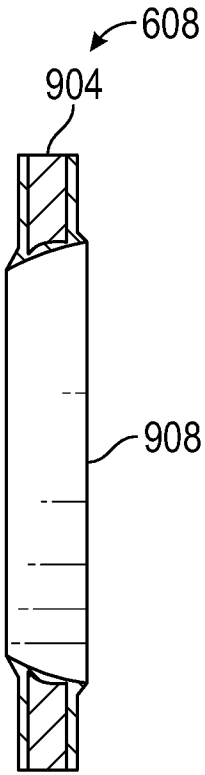
FIG. 9B is a cross-sectional view of a seal assembly according to an alternative embodiment of the invention.
Figure 9A:
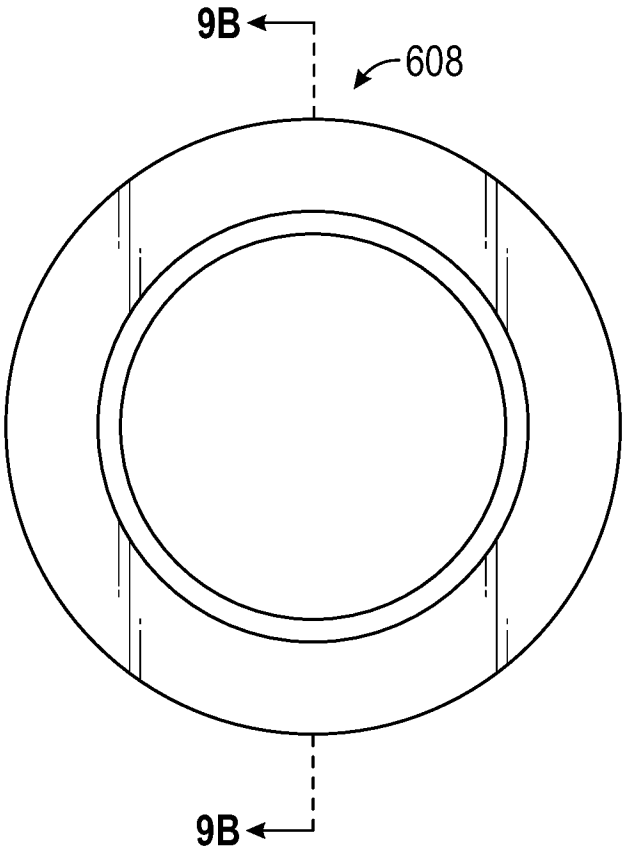
FIG. 9A is a side elevation view of a seal assembly according to an alternative embodiment of the invention.

Now referring to FIGS. 9A-9C, several views of seal assembly 608 of an alternative preferred embodiment of the present invention are provided. In the preferred embodiment, seal assembly 608 is comprised of seal seat 904 and ball seal 908. In a preferred embodiment, ball seal 908 is comprised of an elastic material capable of deforming into seal receiving groove 804.

Figure 10B:
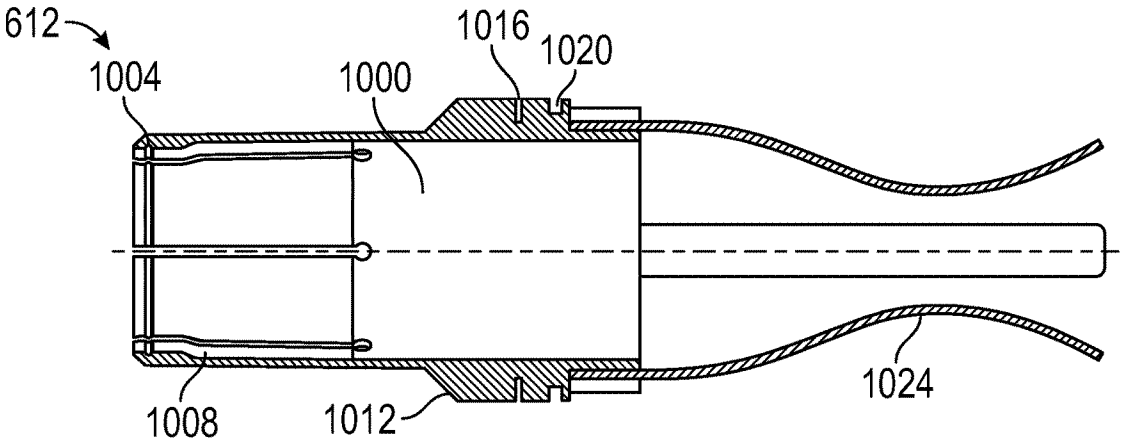
FIG. 10B is a cross-sectional view of a grapple assembly according to an alternative embodiment of the invention.
Figure 10C:
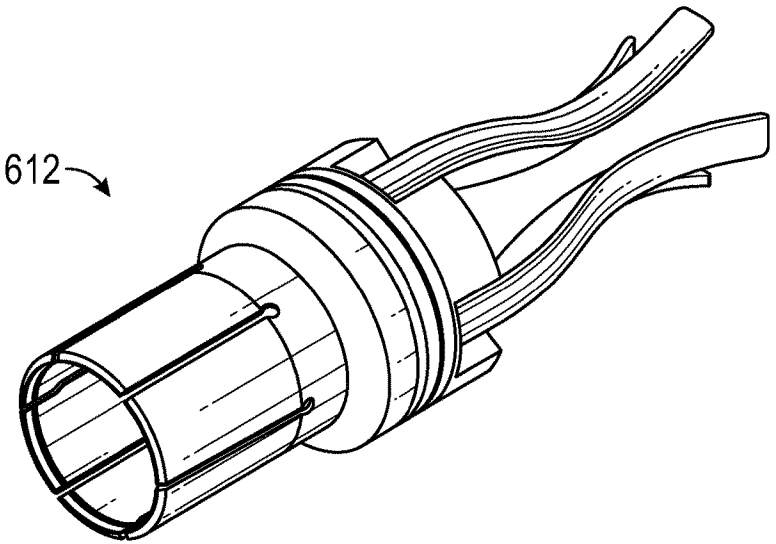
FIG. 10C is a perspective view of a grapple assembly according to an alternative embodiment of the invention.
Figure 10A:
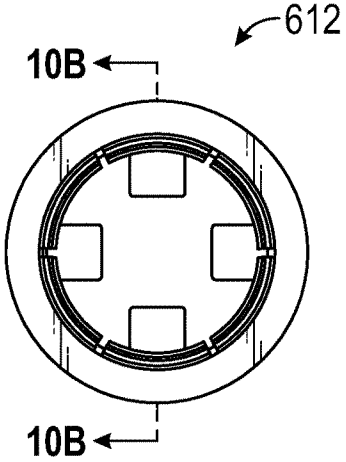
FIG. 10A is a side elevation view of a grapple assembly according to an alternative embodiment of the invention.

Now referring to FIG. 10A-10C, several views of grapple assembly 612 of an alternative preferred embodiment of the present invention are provided. In the preferred embodiment, grapple assembly 612 is comprised of grapple body 1000, ball catch lip 1004, collet fingers 1008, grapple stop 1012, shear ring groove 1016, shear pin groove 1020, and grapple springs 1024. Collet fingers 1008 are disposed on the upper end of grapple body 1000 and grapple springs 1024 are disposed on the lower end of grapple body 1000. In a preferred embodiment of the present invention, grapple body 1000 has an inner diameter that is greater than seal ball 636 to allow seal ball 636 to pass though. However, collet fingers 1008 are disposed about central axis 604 with a circumference that is smaller than the circumference of seal 636, thereby requiring seal ball 636 to be pulled or pushed into collet fingers 1008 using force. Ball catch lip 1004 is disposed about the interior circumference of the top of collet fingers 1008. Grapple body 1000 is further comprised of grapple stop 1012, which is disposed about the lower of end of grapple body 1000. Shear ring groove 1016 is disposed about grapple body 1000 and accommodates placement of shear ring 640. Shear ring 640 further comprises protruding tabs disposed about the shear ring that are rated to shear value in accordance with the application in which the JABS is being applied. In some preferred embodiments, four grapple springs 1024 are disposed about the lower end of grapple body 1000. In other preferred embodiments, more or less than four grapple springs 1024 may be present. Grapple springs 1024 are sufficiently flexible to allow seal ball 636 to pass through with the force provided by the pulling of washpipe, but sufficiently rigid to prevent seal ball 636 from passing through with the force provided by production fluids being extracted from a well. For example, grapple springs 1024 allow seal ball 636 to be pulled through by a washpipe, but do not allow seal ball 636 to reenter grapple assembly 612 when oil or other fluids are being produced from the well. In some embodiments, grapple springs 1024 are designed to break off in the event an intervention operation is desired.

Figure 11A:
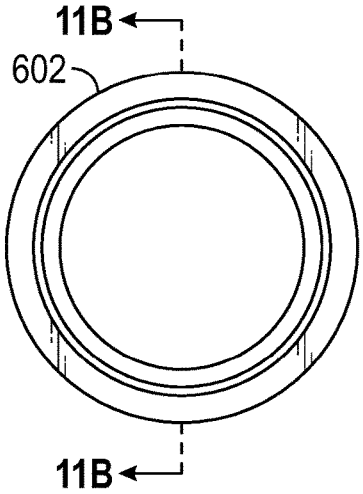
FIG. 11A is a side elevation view of a grapple stop sleeve according to an alternative embodiment of the invention.
Figure 11B:
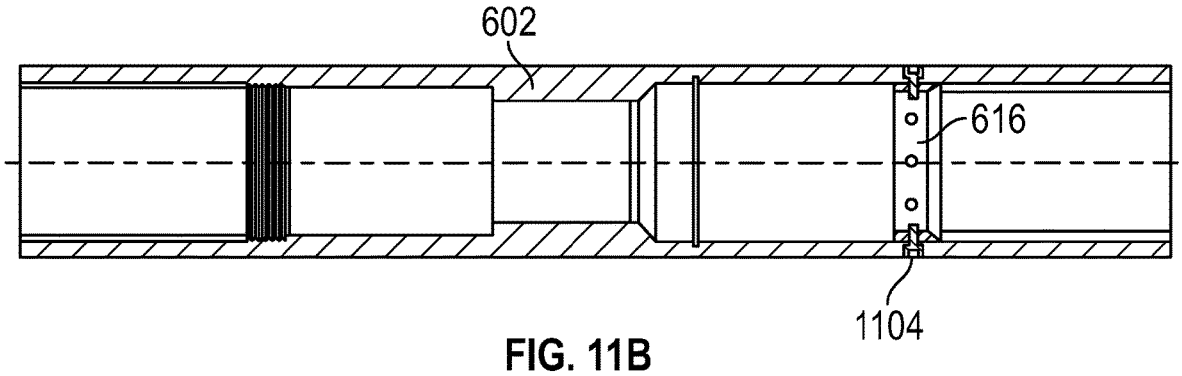
FIG. 11B is a cross-sectional view of a grapple stop sleeve according to an alternative embodiment of the invention.
Figure 11C:
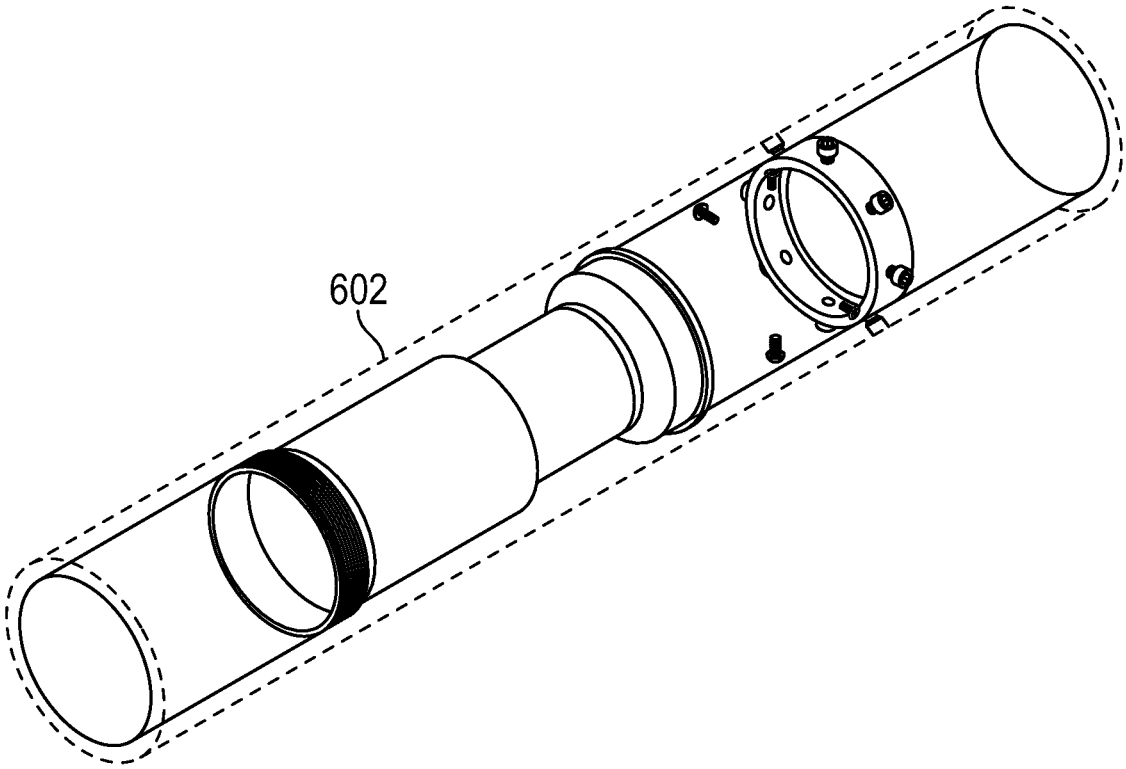
FIG. 11C is a perspective view of a grapple stop sleeve according to an alternative embodiment of the invention.

Now referring to FIGS. 11A-11C, several views of grapple stop sleeve 616 of an alternative preferred embodiment of the present invention are provided. In the preferred embodiment, grapple stop sleeve 616 coupled to the interior of seal sub body 602 using screws 1104.

Figure 12A:
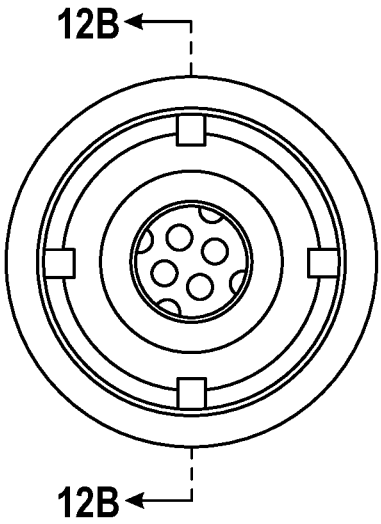
FIG. 12A is a side elevation view of a seal sub sealed by a seal ball according to an alternative embodiment of the invention.
Figure 12B:
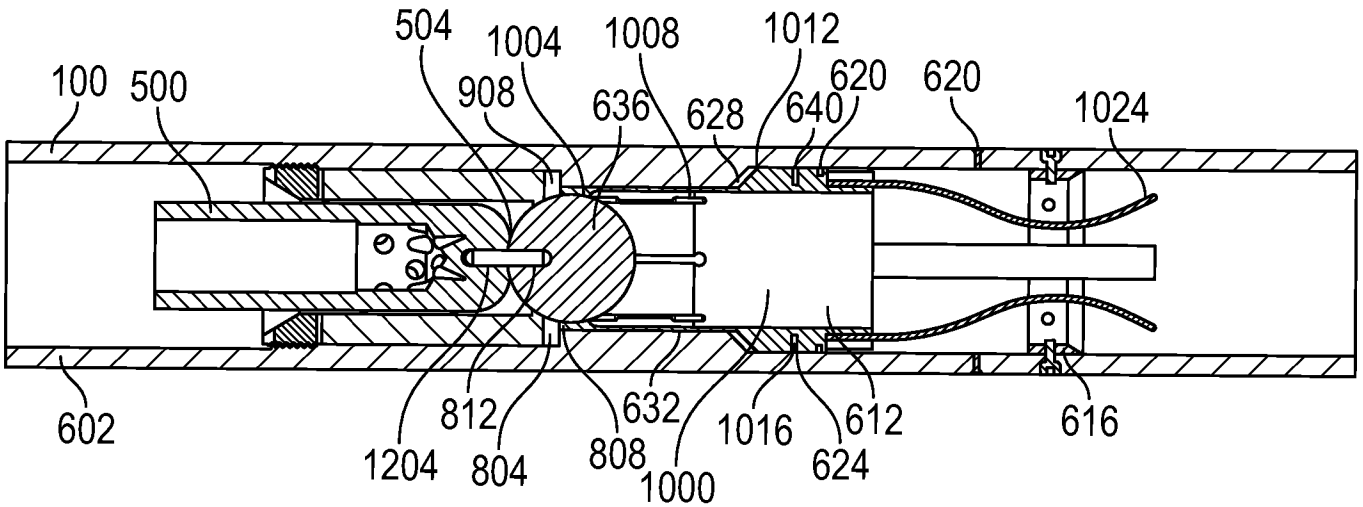
FIG. 12B is a cross-sectional view of a seal sub sealed by a seal ball according to an alternative embodiment of the invention.
Figure 12C:
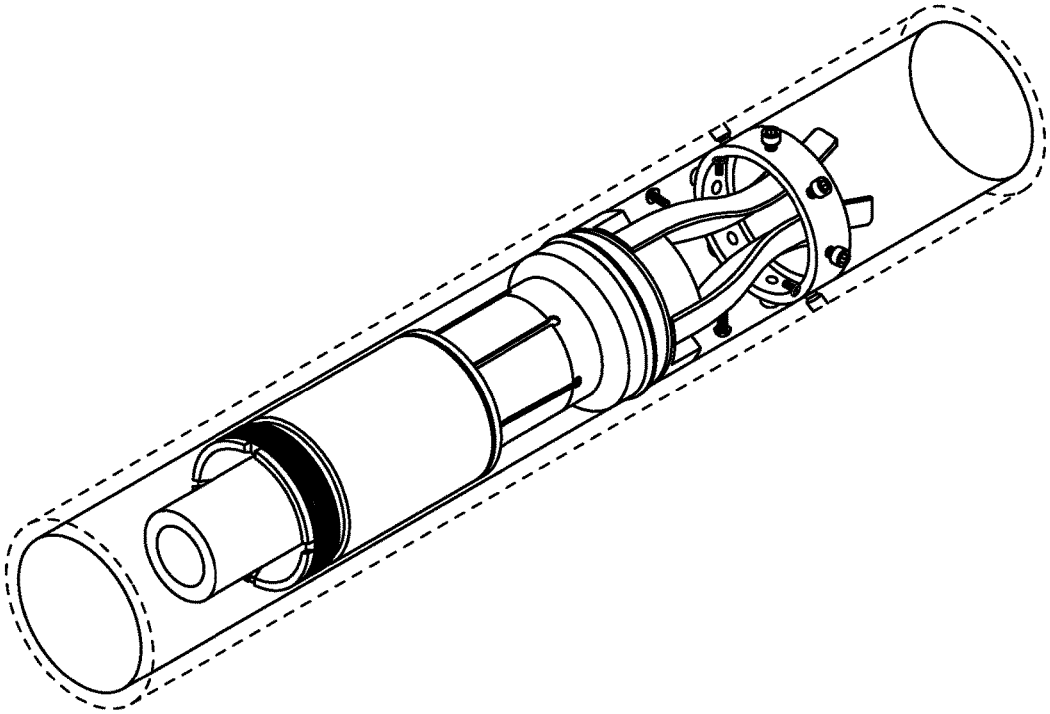
FIG. 12C is a perspective view of a seal sub sealed by a seal ball according to an alternative embodiment of the invention.

Now referring to FIGS. 12A-12C, several views of an alternative preferred embodiment of the present invention once seal ball 636 has engaged with ball seal 908 and ball catch lip 1004, but before shear pin 1204 has sheared, are provided.

In a preferred embodiment, the alternative embodiment of the JABS shown in FIGS. 6A through 12C may be installed downhole as follows. Ball setting tool 500 is coupled to the end of a washpipe, and seal ball 636 is coupled to ball setting tool 500 by threading shear pin 1204 to seal ball connection point 504 and shear pin cavity 812. Seal sub 100 is made up to a gravel pack assembly. Said gravel pack assembly is made up using methods and other components well known in the art, such as packers, extensions, service tools, polished bore receptacles, port closure sleeves, screens, etc., with the outer pipe of a gravel pack service tool being made up to the outer housing of the gravel pack assembly and the inner pipe of the gravel pack service tool being made up to the washpipe to which ball setting tool 500 is coupled. The gravel pack assembly is then run downhole. Once the gravel pack assembly reaches the desired location, a packer in the gravel pack assembly is set by the gravel pack service tool, which disengages the outer housing of the gravel pack assembly, which includes seal sub 100, from the gravel pack service tool.

When sealing seal sub 600 is desired, the gravel pack service tool is picked up, causing the washpipe, ball setting tool 500, and seal ball 636 to move uphole. As the gravel pack service tool is pulled uphole, the washpipe is pulled through seal sub 600, moving seal ball 636 closer to seal sub 600. Once seal ball 636 reaches seal sub 600, and as the washpipe continues to be pulled through seal sub 600, seal ball 636 is pulled through grapple springs 1024, grapple stop sleeve 616, and grapple body 1000. Continuing to pull the washpipe brings grapple catch 808 of seal ball 636 in contact with ball catch lip 1004. Once grapple catch 808 engages with ball catch lip 1004, further pulling of the washpipe results in the shearing of grapple shear screw 620, resulting in grapple assembly 612 becoming disengaged from the interior of seal sub body 602.

Further pulling of the washpipe pulls ball setting tool 500, seal ball 636, and grapple assembly 612 uphole until grapple stop wall 628 meets grapple stop 1012. At this position, grapple shear ring receiver 624 aligns with shear ring groove 1016 and shear ring 640 expands, with the protruding tabs of shear ring 640 engaging with grapple shear ring receiver 624. Further, seal ball 636 engages with ball seal 908 with sufficient pressure that the elastic material of ball seal 908 deforms into seal receiving groove 804. The seal between seal ball 636 and ball seal 908 is now engaged as shown in FIGS. 12A-12C and the well is isolated and sealed above and below seal sub 600. Further pulling the washpipe using a predetermined amount of pressure greater than that for which shear pin 1204 is rated results in shear pin 1204 shearing from seal ball 636. The service tool and washpipe can now be returned to the surface. Once sealed, seal sub 600 and seal ball 636 will withstand a predetermined amount of pressure X from above the seal, and a predetermined amount of pressure Y from below the seal. In a preferred embodiment, pressure Y is greater than pressure X, however it will be appreciated by one skilled in the art that in other preferred embodiments pressure X will be greater than or equal to pressure Y.

When it is no longer desirable to maintain the seal of seal sub 600, seal ball 636 may be jettisoned from seal sub 600 by applying downhole pressure in excess of pressure X. Upon application of such amount of pressure, the protruding tabs of shear ring 640 will shear, thereby disengaging grapple assembly 612 the interior of seal sub body 602. Continuing to apply downward pressure on seal ball 636 results in ball seal 908, seal ball 636, and grapple assembly 612 being forced downward until grapple assembly 612 reaches grapple stop sleeve 616. In some embodiments of the present invention, a secondary shear ring or other catch device will be used to reengage grapple assembly 612 in its original position shown in FIGS. 6A-6C. In some preferred embodiments, ball seal 908 maintains its engagement with seal ball 636 in part due to the spring of retaining nut assembly 606 applying downward force on ball seal 908 as seal ball 636 is forced downwards. Once grapple assembly 612 reaches grapple stop sleeve 616, further pressure results in seal ball 636 being jettisoned out of collet fingers 1008 and through grapple springs 1024, allowing fluid to freely pass through sealable channel 632. In some embodiments of the present invention, seal ball 636 will fall down the well. In some embodiments of the present invention, grapple springs 1024 prevent seal ball 636 from reentering sealable channel 632.

Figure 13:
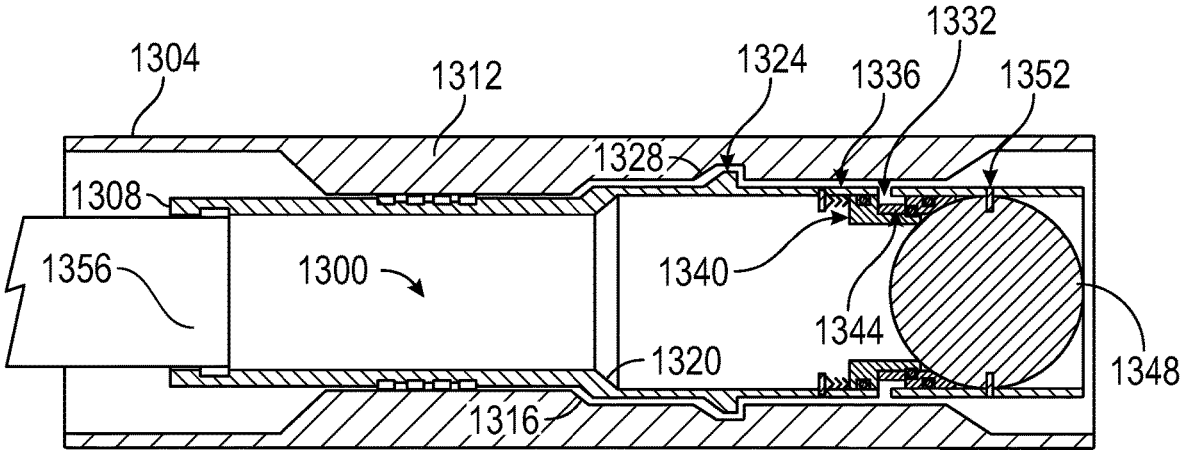
FIG. 13 is a cross-sectional view of a seal sub sealed by a ball according to yet another alternative embodiment of the invention.

Now referring to FIG. 13, a cross-sectional view of yet another alternative preferred embodiment of the present invention is provided. The preferred embodiment disclosed in FIG. 13 helps to eliminate the risk of debris jeopardizing the integrity of the seal between the seal ball and the seal by assembling the seal ball, seal, and grapple before running the assembly downhole. In such an embodiment, the integrity of the seal between the seal ball and the seal can be verified at surface rather than setting the seal downhole by mechanical means. In a preferred embodiment, seal sub 1304 is comprised of a cylindrical body, with the exterior surface of seal sub 1304 being disposed about a central axis and having a uniform outer diameter. The interior surface of seal sub 1304 is further comprised of collet lip 1328, grapple stop wall 1316, and pressure port 1332.

In a preferred embodiment, grapple assembly 1300 is comprised of grapple 1308 and a ball and seal assembly. Grapple 1308 is further comprised of bonded seals 1312, collet teeth 1324, and grapple stop 1320. Bonded seals 1312 may be bonded directly to the exterior wall of grapple 1308 in some embodiments of the present invention. In other embodiments, bonded seals 1312 may be coupled to grapple 1308 through other methods known in the art, such as bonding bonded seals 1312 to metal rings that may then be coupled to grapple 1308 with or without the use of an o-ring. The ball and seal assembly of grapple assembly 1300 is comprised of seal ball 1348, shear pins 1352, seal piston 1340, spring 1336, and ball seat 1344.

In a preferred embodiment, the alternative embodiment of the JABS shown in FIG. 13. may be installed downhole as follows. The components of the ball and seal assembly are pre-assembled before grapple assembly 1300 is placed downhole. Seal ball 1348 is secured to grapple 1308 using shear pins 1352. In the preferred embodiment, seal ball 1348 is spherical, however it will be appreciated by one skilled in the art that a seal ball 1348 of other shapes may be used to practice the invention disclosed herein, such as ovoidal or conical on one end. Shear pins 1352 are rated for the specific application so that shearing can occur at the predetermined amount of pressure X from above. Seal ball 1348 is secured against ball seat 1344 to form a seal. In some embodiments, ball seat 1344 may be constructed in a similar manner and of similar material as ball seal 908. Once assembled, grapple assembly 1300 is made up to the end of a washpipe 1356.

Seal sub 100 is made up to a gravel pack assembly. Said gravel pack assembly is made up using methods and other components well known in the art, such as packers, extensions, service tools, polished bore receptacles, port closure sleeves, screens, etc., with the outer pipe of a gravel pack service tool being made up to the outer housing of the gravel pack assembly and the inner pipe of the gravel pack service tool being made up to the washpipe 1356 to which grapple assembly 1300 is coupled. The gravel pack assembly is then run downhole. Once the gravel pack assembly reaches the desired location, a packer in the gravel pack assembly is set by the gravel pack service tool, which disengages the outer housing of the gravel pack assembly, which includes seal sub 1304, from the gravel pack service tool.

When sealing seal sub 1304 is desired, the gravel pack service tool is picked up, causing the washpipe 1356 and grapple assembly 1300 to move uphole. As the gravel pack service tool is pulled uphole, the washpipe 1356 is pulled through seal sub 1304, moving grapple assembly 1300 closer to seal sub 1304. Once grapple assembly 1300 reaches seal sub 1304, and as the washpipe 1356 continues to be pulled through seal sub 1304, grapple assembly 1300 enters seal sub 1304. As grapple assembly 1300 moves through seal sub 1304, bonded seals 1312 interface with the interior wall of seal sub 1304 at the point where seal sub 1304 is at its narrowest internal diameter. The first of several bonded seals 1312 wipes any debris from the interior wall of seal sub 1304 as grapple assembly 1300 is pulled uphole. Simultaneously, collet teeth 1324 are forced to flex inwards until grapple assembly 1300 moves far enough uphole that collet teeth 1324 lock into collet lip 1328. Once grapple stop 1320 reaches grapple stop wall 1316, further pulling of the washpipe 1356 will not be possible until the washpipe 1356 is disengaged from grapple assembly 1300. The washpipe 1356 may be disengaged through various means known in the art such as shearing of shear pins or mechanical rotation.

Once grapple assembly has been locked into place, the well is isolated and sealed above and below seal sub 1304. The channel passing through the internal diameter of grapple 1308 is sealed by seal ball 1348 and ball seat 1344. The channel running between the outer diameter of grapple 1308 and the inner diameter of seal sub 1304 is sealed by bonded seals 1312. Pressure from below seal sub 1304 assists in maintaining the integrity of the seal between seal ball 1348 and ball seat 1344 by energizing ball seat 1344 through pressure port 1332. Pressure from above seal sub 1304 assists in maintaining the integrity of the seal between seal ball 1348 and ball seat 1344 by energizing ball seat 1344 through applying downward pressure on spring 1336 and seal piston 1340.

Once sealed, seal sub 1304 and seal ball 1348 will withstand a predetermined amount of pressure X from above the seal, and a predetermined amount of pressure Y from below the seal. In a preferred embodiment, pressure Y is greater than pressure X, however it will be appreciated by one skilled in the art that in other preferred embodiments pressure X will be greater than or equal to pressure Y.

When it is no longer desirable to maintain the seal of seal sub 1304, seal ball 1348 may be jettisoned from seal sub 1304 by applying downhole pressure in excess of pressure X. Upon application of such amount of pressure, shear pins 1352 will shear, thereby disengaging seal ball 1348 from the interior of grapple 1308.

In some embodiments of the present invention, seal ball 1348 will fall down the well. In some other embodiments of the present invention, grapple springs, such as grapple springs 1024, may be included to prevent seal ball 1348 from reentering the sealable channel.

Figure 14A:
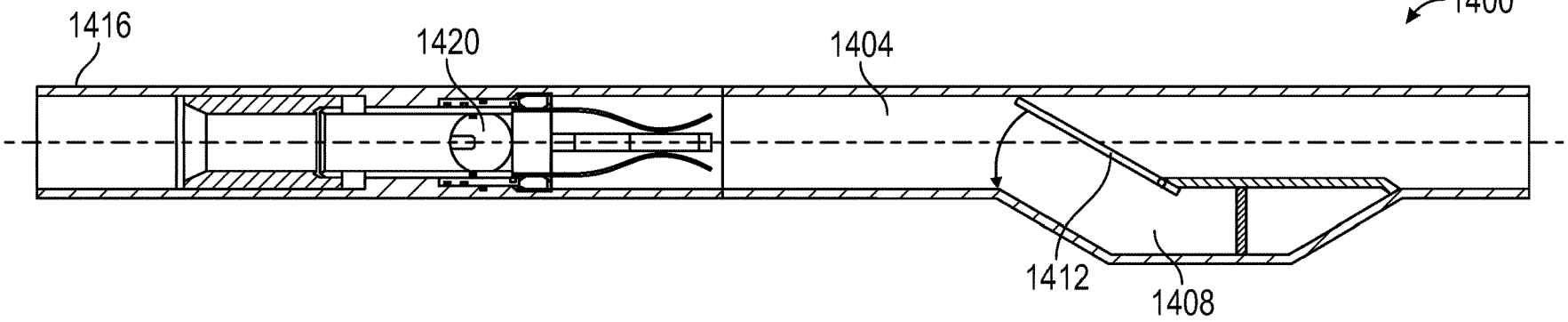
FIG. 14A is a cross-sectional view of a ball catch sub with a lever in a first position according to an embodiment of the invention.
Figure 14B:
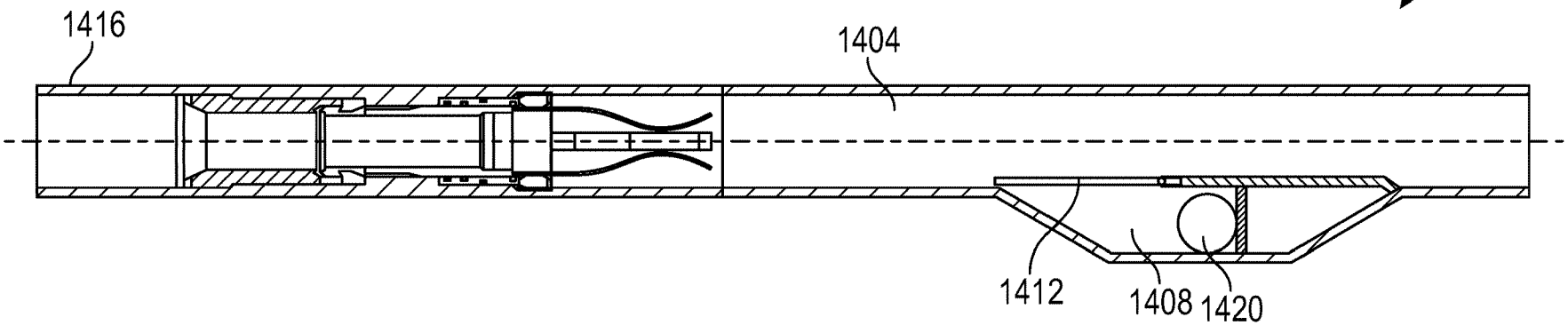
FIG. 14B is a cross-sectional view of a ball catch sub with a lever in a second position according to an embodiment of the invention.

Now referring to FIGS. 14A and 14B, cross-sectional views of a ball catch sub 1400 is provided. In a preferred embodiment, the ball catch sub 1400 is positioned downhole of a seal sub 1416 with a seal ball 1420. However, it will be appreciated that the ball catch sub 1400 could be positioned uphole. In the preferred embodiment, seal ball 1420 is spherical, however it will be appreciated by one skilled in the art that a seal ball 1420 of other shapes may be used to practice the invention disclosed herein, such as ovoidal or conical on one end. As described above, in some embodiments, a fluid pressure from an upper end of the well can be applied to the seal sub 1416 to dislodge the seal ball 1420 and to reverse the isolation of the well provided by the seal sub 1416. The seal ball 1420 can simply fall downhole, or be retained by a feature of the seal sub 1416 such as grapple arms. The ball catch sub 1400 provides a further ability to store the seal ball 1420 once the seal ball 1420 has been dislodged and provides the free flow of fluid through the seal sub 1416 and the ball catch sub 1400.

The ball catch sub 1400 generally comprises a primary channel 1404, a receiving volume 1408, and a ball catch lever 1412. The primary channel 1404 extends along a longitudinal length of the ball catch sub 1400 from a first end to a second end of the ball catch sub 1400. The receiving volume is positioned adjacent the primary channel 1404 or at least in fluid communication with the primary channel 1404. Lastly, the ball catch lever 1412 is positionable between a first position and a second position. In the first position, the ball catch lever 1412 extends partially into the primary channel 1404. The ball catch lever 1412 may have ports or a shape that allows fluid to pass through or around the ball catch lever 1412. When a seal ball 1420 is dislodged and travels downhole, the ball catch lever 1412 in the first position directs the seal ball 1420 into the receiving volume 1408.

To facilitate the change between the first and second positions of the ball catch lever 1412, the ball catch lever 1412 may be hingedly connected to the ball catch sub 1400 at a point between the ends of the ball catch lever 1412. Therefore, as the seal ball 1420 is directed into the receiving volume 1408, the seal ball 1420 contacts a proximal end of the ball catch lever 1412 to rotate the ball catch lever 1412 from the first position to the second position. In the second position, the ball catch lever 1412 is oriented substantially parallel to the longitudinal dimension or axis of the primary channel 1404 and the overall ball catch sub 1400. The ball catch lever 1412 in the second position at least partially defines the receiving volume 1408 and retains the seal ball 1420 in the receiving volume 1408. Additional non-return features can be included to hold the ball catch lever 1412 in the second position. Thus, fluid is allowed to freely flow through the subs and the seal ball 1420 is secured.

Figure 15:
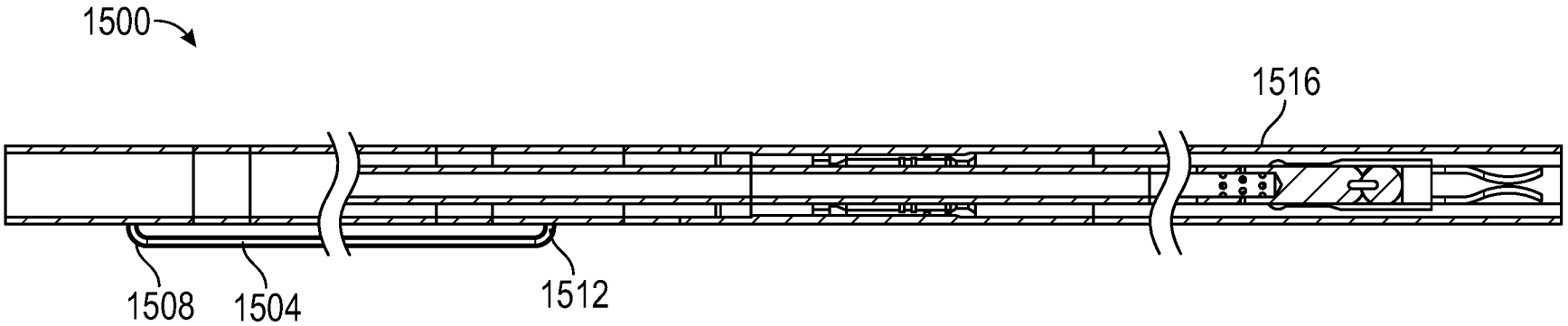
FIG. 15 is a cross-sectional view of a bypass sub according to an embodiment of the invention.

Now referring to FIG. 15, a cross-sectional view of a bypass sub 1500 is provided. The bypass sub 1500 is positioned uphole of a seal sub 1516, but it will be appreciated that the bypass sub 1500 could be positioned downhole. The fluid communication between the seal sub 1516 and a pressure source at a surface location or uphole location transfers pressure to the seal sub 1516 to effect functions such as dislodging a seal ball. However, debris can accumulate in the well to prevent fluid communication from the surface and the seal sub 1516, and debris can even prevent mechanical means from descending downhole to, for instance, dislodge the seal ball. Therefore, the bypass sub 1500 provides an additional path to transfer fluid pressure. In the depicted embodiment, the bypass sub 1500 has a bypass line 1504 that is connected to the bypass sub 1500, and a primary channel therein, at a first point 1508 and a second point 1512. Therefore, a fluid pressure can extend through the debris-free bypass line 1504 to the seal sub 1516. While the bypass line 1504 is depicted as extending out of the primary channel, it will be appreciated that the bypass line 1504 could be a control line, an inner pipe annulus, etc.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A system for isolating a wellbore, comprising:

a seal sub having an inner surface with an inner diameter and a lip forming a recess in the inner surface;

a grapple assembly having an outer surface with an outer diameter and a collet extending outward from the outer surface, and the grapple assembly having an inner surface with a ball seat;

a seal ball positioned adjacent the ball seat, and the seal ball selectively connected to the inner surface of the grapple assembly with at least one shear pin that is configured to break when subjected to a predetermined force;

a washpipe selectively connected to an upper end of the grapple end assembly, wherein the washpipe and the grapple assembly travel uphole together to secure the relative position of the seal sub and the grapple assembly; and wherein as the grapple assembly travels uphole, the inner surface of the seal sub deflects the collet inwards until the collet reaches the lip, and the collet deflects outward into the recess in the inner surface to secure the relative position of the seal sub and the grapple assembly.

2. The system of claim 1, further comprising:

a bonded seal positioned on the outer surface of the grapple assembly such that the bonded seal forms a seal between the outer surface of the grapple assembly and the inner surface of the seal sub to isolate, in conjunction with the seal ball, an uphole pressure from a downhole pressure.

3. The system of claim 1, further comprising:

at least one grapple spring on the grapple assembly, the at least one grapple spring is configured to prevent the seal ball that is dislodged from the grapple assembly from returning to the ball seat.

4. The system of claim 1, further comprising:

a catch sub positioned downhole of the seal sub, the catch sub having a primary channel extending through the catch sub, a ball catch lever movable between a first and a second position, and a receiving volume in fluid communication with the primary channel;

wherein, when the ball catch lever is in the first position, the ball catch lever directs the seal ball that is dislodged from the grapple assembly from the primary channel to the receiving volume;

wherein, when the ball catch lever is in the second position, the ball catch lever retains the seal ball in the receiving volume.

5. The system of claim 1, further comprising:

a bypass sub uphole of the seal sub, the bypass sub having a primary channel and a bypass line, wherein the bypass line is in fluid communication with the primary channel at a first and a second location along a longitudinal length of the primary channel, wherein a pressure increase is transferred from the first position, through the bypass line, and to the second position located downhole of the first position.

* * * * *